US006648713B1

(12) United States Patent
Oquita

(10) Patent No.: US 6,648,713 B1
(45) Date of Patent: Nov. 18, 2003

(54) SHROUDED CHAMBER PIÑATA

(76) Inventor: Ramiro Oquita, 6014 Chandler St., San Diego, CA (US) 92117

( * ) Notice: Subject to any disclaimer, the term of this patent is extended or adjusted under 35 U.S.C. 154(b) by 0 days.

(21) Appl. No.: 10/207,437

(22) Filed: Jul. 26, 2002

(51) Int. Cl.[7] ..... A63H 33/00
(52) U.S. Cl. ..... 446/5; 446/73; 446/487
(58) Field of Search ..... 446/4, 5, 71, 73, 446/76, 475, 487–489; 383/6–9, 22, 24, 204, 205, 119

(56) References Cited

U.S. PATENT DOCUMENTS

| | | | | | |
|---|---|---|---|---|---|
| 3,006,532 | A | | 10/1961 | Fine | |
| 3,349,992 | A | | 10/1967 | Skinner | |
| 3,702,675 | A | | 11/1972 | Bajo | |
| 4,015,364 | A | | 4/1977 | Oquita | |
| 4,092,798 | A | | 6/1978 | Oquita | |
| 4,167,078 | A | | 9/1979 | Oquita | |
| 4,186,514 | A | | 2/1980 | Oquita | |
| 4,253,266 | A | * | 3/1981 | Bajo | 446/5 |
| 4,787,872 | A | | 11/1988 | Bajo | |
| 4,930,903 | A | | 6/1990 | Mahoney | |
| 5,242,308 | A | * | 9/1993 | Estrada | 434/365 |
| 5,263,889 | A | | 11/1993 | Ledonne | |
| 5,536,194 | A | | 7/1996 | Larsen et al. | |
| 5,613,312 | A | | 3/1997 | Crowell | |
| 5,824,378 | A | | 10/1998 | Armendariz et al. | |
| 6,171,166 | B1 | | 1/2001 | Oquita | |
| 6,345,912 | B1 | * | 2/2002 | Ho | 383/20 |
| 6,354,904 | B1 | | 3/2002 | Grey et al. | |

* cited by examiner

*Primary Examiner*—Jacob K. Ackun
*Assistant Examiner*—Bena B. Miller
(74) *Attorney, Agent, or Firm*—Knobbe Martens Olson & Bear

(57) ABSTRACT

A shrouded chamber piñata is disclosed having an inner chamber and a surrounding outer chamber or shroud. The inner chamber has an opening on one side, and one or a plurality of handles fixably attached to the chamber and extending outwardly from the opening of that chamber. A pull line, fixably attached at one point to a first ribbon, and fixably attached at a second point to a ring, passes through at least one face of the chamber, so that when the pull line is pulled with sufficient force the chamber will rupture. A support member is attached to the inner chamber to provide attachment points for the first ribbon and additional ribbons. A shroud having openings on opposite sides is positioned atop the containing chamber to shroud the containing chamber. One of the shroud openings is positioned on the same side as the inner chamber opening.

23 Claims, 13 Drawing Sheets

SHROUDED CHAMBER PIÑATA

BACKGROUND OF THE INVENTION

1. Field of the Invention

The invention relates to the field of amusement devices and games of chance. More particularly, the invention relates to a type of amusement device commonly known as a piñata.

2. Description of the Related Art

Piñata breaking celebrations are quite popular in Mexico and in the Mexican communities of the United States. Traditionally, piñatas are constructed of a clay pot or container ornamented with colorful paper and filled with candy, nuts, confetti, and/or token gifts such as light-weight toys and the like, collectively referred to as treats. The piñata is suspended above a party area and at the appropriate time and with celebration, the piñata is broken so that the treats are scattered among the several guests who in turn may generally keep whatever treats each collects. The usual method of breaking the piñata is by beating it with a club or cane. This is done by a blindfolded participant—usually, but not necessarily, a child—who is the subject of the celebration. Alternatively, several participants in succession are each given a certain number of turns in which to attempt to break the piñata. Unfortunately, as a result of the enthusiasm of one or more of the participants in gathering close to the piñata so as to collect a larger number of treats, it occasionally happens that a participant in the celebration is hit by the club or by the cane used to break the piñata. Additionally, the traditional piñata made of clay pottery may break into large fragments which can fall and cause injury. Modern piñatas are often made of paper maché or cardboard, thereby avoiding some of the dangers presented by cracked clay fragments. However, modern piñatas are generally more difficult to break, requiring greater swings with the resultant greater danger from that aspect to the participants.

Storage and transportation for traditional, and even modern, piñatas are awkward and difficult because of the bulkiness of an assembled, ready-to-use piñata. Furthermore, even modern piñatas are relatively difficult, expensive, and time-consuming to construct in a ready-to-use state, and often must be stored with treats inside for long periods of time. This requirement of extensive storage in a ready-to-use state often precludes the use of perishable treats, such as many types of candies and gums, in the piñatas.

Other piñata embodiments, such as those disclosed in U.S. Pat. No. 6,171,166, (the '166 patent) utilize an outer shroud that is positioned in an inverted orientation relative to an inner container. The piñatas disclosed in the '166 patent are improvements over piñatas that must be struck with a bat or cane in order to release the treats contained within. However, the piñatas disclosed in the '166 patent also have shortcomings. These piñatas are expensive to produce and difficult to assemble because of the inverted orientation of the outer shroud. Moreover, such piñatas may exhibit difficulty in maintaining their structure and sidewall stiffness during use.

Accordingly, there exists a need for containers, and especially piñatas, that are not awkward, difficult, or expensive to store, and for piñatas that may be easily stored without treats enclosed, and constructed just prior to use. Additionally, there exists a need for containers, especially piñatas, that are made of relatively inexpensive materials, and that are neither expensive nor time-consuming to construct into a ready-to-use state. There also exists a need for such piñatas that can be easily constructed into a ready-to-use state by those with no special training. There is also a need for piñatas that may be used as amusement devices without the need to use a club or cane to release the enclosed treats.

SUMMARY OF THE INVENTION

A piñata is disclosed having an inner chamber and an outer shroud substantially covering the inner chamber. One or more ribbons or other release mechanisms are releasably attached to the inner chamber. Alternatively, the ribbons or release mechanisms may be releasably attached to a support member that is attached to the inner chamber. At least one of the ribbons or release members is attached to a filament tape that is attached to an inner surface of the inner chamber. The end of the filament tape opposite the ribbon may be attached to a stick or rod to facilitate rupturing of the inner chamber. Alternatively, at least one of the ribbons is attached to a pull line that is threaded through holes positioned on or near a bottom wall of the inner container. The pull line may be positioned such that it crosses within the inner container. The pull line operates to rupture the inner container when a desired, or winning, ribbon is pulled with sufficient force. The outer chamber has first and second openings on substantially opposite sides. One of the openings is on the same side as an opening of the inner container.

BRIEF DESCRIPTION OF THE DRAWINGS

The accompanying drawings, which form part of the specification, merely illustrate embodiments of the present invention. Together with the remainder of the specification, they are meant to serve to explain certain of the principles of the invention but do not limit the scope of protection afforded for the invention.

DETAILED DESCRIPTION OF EMBODIMENTS OF THE INVENTION

Figure 1:
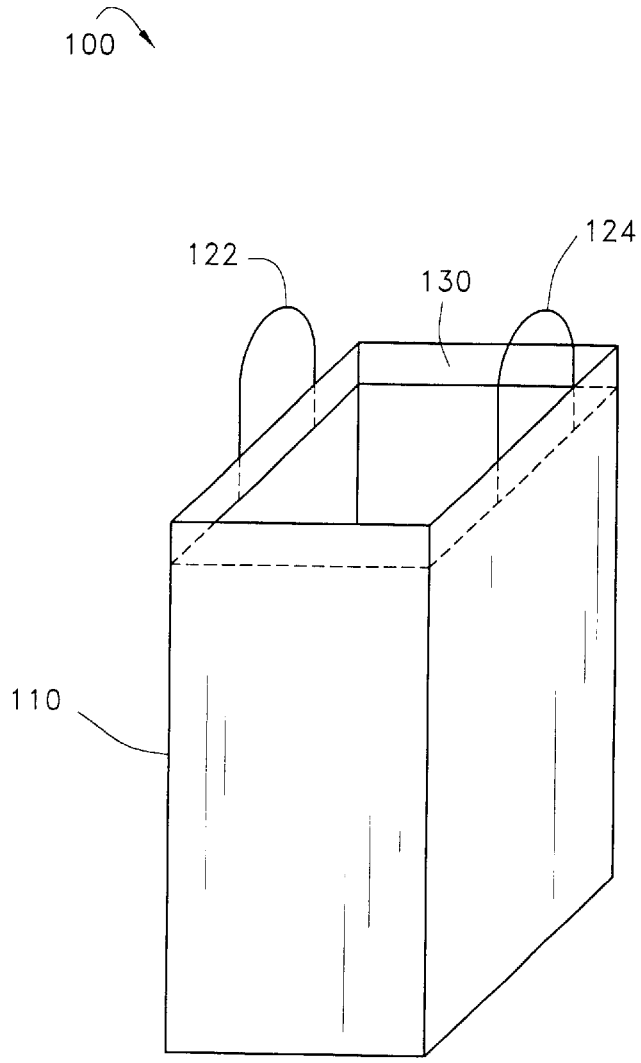
FIG. 1 illustrates an isometric view of a containing chamber of a piñata.

A piñata is described that allows for minimal storage space, is easily constructed, is made of relatively inexpensive materials, may be constructed by those with no special training, and may be used as an amusement device without the need for a club or cane to release the treats.

A piñata embodiment disclosed provides an inner chamber herein referred to as a containing chamber or, alternatively as a "first" or inner chamber, used to support and enclose a plurality of treats, such as candy, toys, and the like. This chamber is composed of frangible material, or alternatively, may be comprised in part of a frangible material, or may be composed of a material that may easily be torn, or otherwise ruptured. The first or containing chamber may be a paper bag, a laminated bag, a plastic bag, a sack, a cloth sack or bag, a box, a paper box, a cardboard box, a plastic container, a synthetic container, a cup, a bucket, or some other containing means. The first chamber may, in some embodiments, be a paper bag. This chamber may be a paper bag of the conventional type, but may include bags of all materials and shapes, so long as not all of the specified purposes are defeated. A paper bag of the conventional type, has a rectangular folded bottom and side folds, the bag being of generally rectilinear shape, such that the chamber may be conveniently folded and stored in a flattened state. The paper bag may have one or a plurality of handles attached and extending outward from an opening. Alternatively, handles may be fixably attached to the opening of the first chamber using tape, adhesive, clips, or some other type of mechanical attachment. Additionally, the handles may themselves by inserted through openings in the first chamber and attach loosely to the first chamber through these handle openings.

To form a piñata or amusement device, a plurality of ribbons may also be removably attached to the inner containing chamber to provide color and appropriate décor, as well as to provide a disguise for a winning ribbon. A winning ribbon is attached to a pull line which, when pulled with sufficient force, will rip or rupture the inner chamber and thus release the treats from within that chamber, and out through an opened side of the outer, shroud chamber and out to the game's participants. Alternatively, a plurality of ribbons, each separately removably attached to the inner chamber, provide a disguise for one or several winning ribbons, each of which is attached, either collectively or separately, to a single or to multiple pull lines which, when pulled with sufficient force, will each rupture the inner chamber and release the treats from within that chamber and out through the opened face of the outer shroud chamber and out to the game's participants. Alternatively, yarn, thread, string, a string of beads, filament tape, plastic, wire, tape, or some other means for releasing the contents of the containing chamber may be used to attach to the pull line and function as an interface to the pull line.

In one embodiment, a support member may be attached to the inner chamber. The winning ribbon is attached to the inner chamber. A plurality of ribbons other than the designated "winning" ribbons are removably attached to the support member. In another embodiment, the support member forms a part of the inner chamber. The support member may include slots, holes, clips, or some other provision for removably attaching the ribbons. The ribbons may be removably attached to the support member using the slots, holes, clips, or other provisions of the support member. The removable attachment may be by mechanical means, such as an interference fit, or by an adhesive, tape, or other nonpermanent means of attachment.

The above-mentioned pull line, which may be a nylon fishing line, a piece of high-tensile-strength wire, a piece of dental floss, a piece of nylon cord, yarn, filament tape, a piece of plastic, a rope, a chain, a thread, or some other means for rupturing the containing chamber, is affixed to at least one winning ribbon. As discussed above, the pull line may be affixed to a single winning ribbon or may be affixed to multiple winning ribbons.

In one embodiment, the pull line is a piece of filament tape attached to an inside wall of the containing chamber. The winning ribbon is attached to one end of the filament tape. When the winning ribbon is pulled with sufficient force, the filament tape pulls down and ruptures the inner chamber. The end of the filament tape opposite the winning ribbon may be fixably attached to a stick, rod, or some other rigid form. The stick is used to further facilitate the rupturing of the inner chamber when the winning ribbon is pulled with sufficient force.

The pull line may also be fixably attached to a ring. In another embodiment, a single winning ribbon is fixably attached to the pull line at a point that is at substantially one end of the pull line. The ring is attached to the pull line at point that is at substantially the end of the pull line opposite the winning ribbon. Furthermore, the pull line may be threaded through apertures in the inner containing chamber. These apertures are large enough to allow the pull line to pass through, but are not typically large enough to allow any of the treats to pass through, unless and until the containing chamber is ruptured in the above-described manner. Thus, these apertures can be made with a toothpick, pin, or other means of creating a pin hole, and are typically not reinforced. These apertures may be perforated to encourage rupture of the chamber along predetermined lines. In one embodiment, the toothpick or pin holes are connected to one or more perforations in the inner chamber to facilitate rupture of the inner chamber upon pulling of the winning ribbon with sufficient force. Accordingly, the pull line is long enough to thread through a toothpick or pin hole at one end of one face of the inner chamber and back up through another pin hole at the other end of that face of the inner chamber, and to a point on the pull line where it is affixed to the ring. When the piñata is prepared for use, the ring may be affixed to a location point that provides support for the pull line such that when the winning ribbon is pulled, the pull line ruptures the inner chamber. The location point may be a face of the inner chamber, one of the handles of the inner chamber, or a support that is external to the piñata, such as the point from which the piñata hangs. Alternatively, the handles of the inner chamber may be inserted through the ring such that they support the ring.

When the "winning" ribbon is pulled with sufficient force, the pull line tears, ruptures, or otherwise opens the inner containing chamber. In the embodiment where the pull line is a filament tape attached to an inner wall of the inner chamber, the pull line is positioned vertically with respect to the orientation of the inner chamber. When the winning ribbon is pulled with sufficient force, the filament tape causes the inner chamber to rupture. Attaching the filament tape to the inner wall of the inner chamber results in the rupturing force being applied in a downward direction, the same direction in which the ribbon is being pulled.

Alternatively, the pull line may be initially positioned with respect to the inner chamber in the following manner: it is threaded through the above-described holes and pulled through the inner chamber. One end of the pull line may be affixed to a winning ribbon and the opposite end of the pull line affixed to the ring. The handles of the inner chamber are looped through the ring prior to hanging the piñata on a support. When the pull line is drawn taunt, the corresponding ribbon to which it is attached hangs inconspicuously at the same length as the other ribbons other than the designated "winning" ribbons. In this manner, the ribbons other than the designated "winning" ribbon provide a disguise for the single or for multiple winning ribbons, that is, the only ribbons that are attached to one or, as the case may be, multiple pull lines.

Ribbons, both those connected to the pull line and those not so connected, can be affixed with a label or card, generally at a location on either the upper end or the lower end of the ribbon. These labels may include writings in which questions are asked, deeds are assigned, or prizes may be awarded to the participant. These questions, deeds, prizes or the like are selected so as to be suitable for the participants of the game. For example, simple questions may be used for a child's birthday group, and academic questions used for a school party. Also, as may be appropriate for occasion, deeds may include singing a birthday song, requests that the participant dance on his head, or the like.

In one embodiment, multiple ribbons are used which are not connected to the pull line. Each of these ribbons constitutes a non-winning ribbon because they will not initiate rupturing of the inner chamber when pulled. Each of the non-winning ribbons is attached at a top end to a label. The label is folded over a ribbon support, which may be a string, thread, wire, yarn, cable, twine, or other hanger or ribbon support. The folded label is then attached to itself or to the ribbon to which it is attached. Thus, when the non-winning ribbon is pulled, the label tears at the fold and releases from the ribbon support. The ribbon support may be assembled with multiple ribbons and then the assembled ribbon support may be attached to the support member of the inner chamber.

In one embodiment of the invention, each participant will pull a ribbon in sequence until the winning ribbon is pulled and the inner bag is accordingly ruptured by the person who finds the, or a, winning ribbon, for example, a ribbon affixed to a pull line. Prior to pulling the winning ribbon, the participants engage in the activities described on the labels, for instance, answering questions or executing specific activities for example, dance like a duck, sing a song, recite the alphabet backwards, etc.

The piñata includes an outer chamber herein referred to as a shroud chamber or, alternatively as an outer, or "second" chamber, which may be fancy or decorated, and may include, or even be completely covered by, an advertisement or logo, or may be designed so as to represent a wrapping for a piece of candy or gum. Such an advertisement, logo, or candy or gum wrapper representation has the additional benefit of being indicative of the treats that are contained in the completed, ready-to-use piñata. This chamber may be a paper bag, but may be made of any material and may have any shape, while keeping in mind one or more of the purposes of the invention. Specifically, this chamber may be a laminated paper bag that may be used multiple times with distinct piñatas. Such a laminated paper bag will be more durable than a conventional paper bag and will be easily folded and stored. This shroud chamber need not rupture to achieve any of the purposes of the invention. As will be understood by those of skill in the art, such a shroud chamber, for example, a laminated paper bag, has a rectangular folded bottom and side folds, the bag being of generally rectilinear shape, such that the chamber may be conveniently folded and stored in a flattened state, and may have attached handles. It may be appreciated that the shroud chamber may alternatively be a paper bag, a laminated paper bag, a plastic bag, a sack, a cloth sack or bag, a box, a paper box, a cardboard box, a plastic container, a synthetic container, a cup, a bucket, pieces of material, pieces of plastic, metal, combinations of materials, or any other means for shrouding the containing chamber.

To form a completed, ready-to-use piñata, the outer chamber may be used to serve as a shroud to cover the inner chamber. In one embodiment of the invention, this may be accomplished by positioning the shroud around the inner chamber. The shroud may be formed of one, or a plurality of, sheets of paper. The sheet or sheets of paper may be joined using tape, adhesive, staples, or some other means for joining the sheets, such that a shroud having one or more sides and a substantially open top and bottom is created. The paper may be pre-printed with language or a design.

Additionally, a form may be manufactured having substantially the same area as one of the openings in the shroud. The form may be inserted in a top opening of the shroud to cause a cross section of the shroud to conform to the shape of the form. The form may be attached to a portion of the shroud using adhesive, tape, staples, or an interference fit. The form may also have an opening through which the handles of the inner chamber may protrude. Thus, the protruding handles of the inner chamber provide support for the shroud. For example, the form may be circular shaped and, when the form is inserted into the shroud, the cross section of the shroud appears substantially circular. Similarly, the form may be hexagonal, octagonal, or some other shape, and the cross section of the shroud takes on a corresponding shape. The form may be manufactured of cardboard, heavy paper, wood, or some other material. The piñata may be stored without the form inserted within the shroud. Thus, the shroud may be folded flat and stored in the substantially flat condition along with the inner chamber and form.

Alternatively, a strap or loop may be attached to the shroud. The shroud may then be supported by the inner chamber. In this embodiment, the strap or loop attached to the shroud rests on the inner chamber, thus supporting the shroud.

Alternatively, the shroud may be formed from a paper bag that is large enough to shroud the inner chamber. When the shroud is formed from a paper bag, the bottom of the bag, or a substantial portion of the bottom of the paper bag, is removed. By removing all, or a substantial portion of the bottom of the shroud bag, the shroud bag may be used in an upright manner and provide an opening through which the ribbons to hang down. This allows the use of pre-printed material on the shroud. The use of a paper bag having pre-printed material is undesirable if the shroud chamber is used in a manner such that the original opening is located facing the bottom of the piñata. This is because any pre-printed text or graphic would be inverted. By removing all, or substantially all, of the bottom of the shroud bag, the pre-printed material on the shroud chamber remains in a more desirable orientation. Use of preprinted materials make construction of the piñata less expensive and time consuming. Furthermore, because available preprinted paper bags may have text and graphics for a variety of occasions, for example a birthday or other celebration, pre-printed shroud chambers may be readily available for many occasions. If the outer shroud is inverted, graphics or text must be printed on the shroud such that they are correctly oriented when the outer shroud is placed in its inverted orientation. The upright orientation of the outer shroud alleviates the problems associated with inverted text or graphics. Additionally, where the shroud is formed from a paper bag, a paper bag having handles may be used such that the inner chamber and the shroud chamber are both supported using their respective handles. It may be appreciated that the disc, discussed above, may also be inserted in a shroud chamber comprised of a paper bag. The cross section of the paper bag substantially conforms to the shape of the disc if the bottom of the bag is removed. Additional chambers may be placed upon the piñata as desired. The handles of the shroud may be configured in a crossed manner. One end of a handle may extend from a first side of the shroud to an opposite side of the shroud. Additionally, a second handle may extend from the opposite side of the bag to the first side of the shroud such that the two handles cross in substantially the center of the opening of the shroud. Then the handles may rest on the inner chamber such that the shroud is supported by the inner chamber.

Furthermore, as is noted above, piñatas are traditionally suspended above a party area. Accordingly, the containing chamber may have affixed handles. The handles serve to suspend a completed (or ready-to-use) piñata, supporting in an upright orientation the containing and shroud chambers as well as the enclosed treats and any ribbons and pull lines that form part of the piñata. These handles will serve to support the suspended inner, containing chamber, with its contents of treats, its attached ribbons, and pull line, as well as to support the shroud chamber. The handles may also serve as the location point for the ring attached to a pull line. The handles may be fixably attached to the containing chamber in any conventionally known manner, such as by glue, staples, or the like, provided the handles are sufficiently durable to serve to support an entire ready-to-use piñata.

The piñata may also be constructed from readily available materials as described herein. Alternatively, a kit may be provided for easy of construction. Such a kit will, at a minimum, provide an inner, containing chamber, to replace a previously ruptured containing chamber, the containing chamber having holes through which a pre-positioned pull line may be passed. Typically, such a kit will also provide a plurality of ribbons and means to removably attach those ribbons, each separately, to the inner, containing chamber.

An advantage of providing the piñata of the present invention as a kit will also be realized if a shroud chamber is provided in the kit. Such a shroud chamber may optionally have located on it a logo or advertisement of the manufacturer, supplier, or sponsor of the kit. Thus, the kit itself could also contain and serve as an advertisement for the treats to be enclosed in the piñata. Of course, the kit may also include cards, upon which are written text or graphics detailing the tasks or questions that comprise part of the game to be played.

The piñata as disclosed herein has advantages over piñatas previously available. The piñata as disclosed herein may be manufactured at a lower materials and labor cost over previous piñatas. One advantage of the piñata is its use of an outer shroud having an upright orientation. The use of an outer shroud with an upright orientation allows the use of pre-printed materials, such as pre-printed bags, to be used as the outer shroud. This reduces the expense in manufacturing the piñata because pre-printed bags having text and graphics covering a variety of occasions are readily available. If the outer shroud is positioned in an inverted orientation, the use of pre-printed bags is excluded, or may only be used to cover the inverted outer chamber, thereby increasing the cost of the piñata.

Additionally, the use of an upright oriented outer shroud having a removed bottom allows for a greater ease of assembly. In previous piñatas where an inverted outer shroud was placed over an inner chamber, the outer shroud needed slots or notches cut into the bottom such that the handles of the inner chamber could extend through and be used to support the piñata. Cutting the positioned slots in the outer chamber creates another manufacturing step that adds to the time and cost of producing the piñata. An embodiment that uses a bag as the outer chamber where the bag has substantially all or all of the bottom removed, allows for ease of manufacture. There are fewer steps and a lower level of detail required in removing the bottom of a bag. Moreover, when assembling the piñata the handles of the inner chamber need not be threaded through corresponding slots in the outer chamber. This step of manufacture was previously difficult because an inverted bag shrouds the placement of the handles and greatly reduces the ability to guide the handles of the inner container through the slots.

The placement of the pull line on an inner surface of the inner chamber allows the rupturing force to be applied in a downward direction. The downward rupturing force coincides with the downward force applied to the winning ribbon when it is pulled. The downward rupturing force more easily ruptures the inner chamber than does the upward force applied by a pull line threaded through a floor of the inner chamber.

Alternatively, the placement of the pull line in the embodiment where the pull line extends through the inner chamber floor may be improved. A placement of the pull line, wherein the pull line crosses inside the inner container greatly increases the ability of the pull line to rupture the inner container when the desired ribbon is pulled. When the pull line does not cross within the inner chamber, the pull line may potentially not exert sufficient force on the inner chamber such that it ruptures. The inclusion of the ring on the end of the pull line also serves to support the pull line and allows the pull line to be further supported at the same location that the piteonata is supported. The inclusion of the ring also allows the pull line end to be placed anywhere relative to the piteonata, further facilitating rupturing of the inner container when the desired ribbon is pulled.

The features of the piteonata, and various embodiments that illustrate examples of the wide range of alternatives in constructing the piteonata, are shown in the accompanying figures. FIG. 1 shows an inner container 100 of the piteonata. It may be seen that the inner chamber 100 may be formed of a bag, such as a paper bag. The bag may be of rectilinear shape but it may be appreciated that the inner chamber may have nearly any shape capable of containing the treats or rewards that are to be placed inside the completed piteonata. The inner chamber 100 may be laminated paper, plastic or the like so long as not all of the purposes of the inventions are defeated. Such bags are convenient for the construction of the inner chamber 100 because the bag may be shipped in a folded or collapsed condition. The containing, or inner, chamber 100 has affixed to it, two handles 122 and 124. The handles, 122 and 124, are positioned in a mirror image across the opened face of the containing chamber 100. The handles 122 and 124 may be of any suitable type shape or conformation, and are illustrated in FIG. 1 as relatively stiff cord-like members connected to the bag in a conventional orientation. The handles may be attached to the containing chamber 100 by gluing, stapling, affixing with tapes, or other methods of fastening, as will be understood by those of skill in the art. The handles may be attached to inner walls the containing chamber 100, or alternatively may be attached to the outer walls of the containing chamber 100. It may be appreciated that although a bag typically has two handles, a containing chamber may be constructed using only one handle that spans two of the sides of the chamber.

The containing chamber 100 may optionally include a support member 130. The support member 130 may be formed on the open end of the containing chamber 100 and be used to attach the handles 122 and 124, ribbons, or release mechanisms used to release the treats from the piteonata. The support member 130 shown in FIG. 1 extends to the edge of the open end of the containing chamber 100. However, it may be appreciated that the support member 130, when formed as part of the containing chamber 100, may be formed entirely within the chamber such that it is not visible from outside of the chamber. The treats or other rewards used with the piteonata are typically inserted in the containing chamber 100 through the open end. Thus, fully assembled, the piteonata will contain treats for dispersion once the piteonata is ruptured or otherwise opened.

Figure 2A:
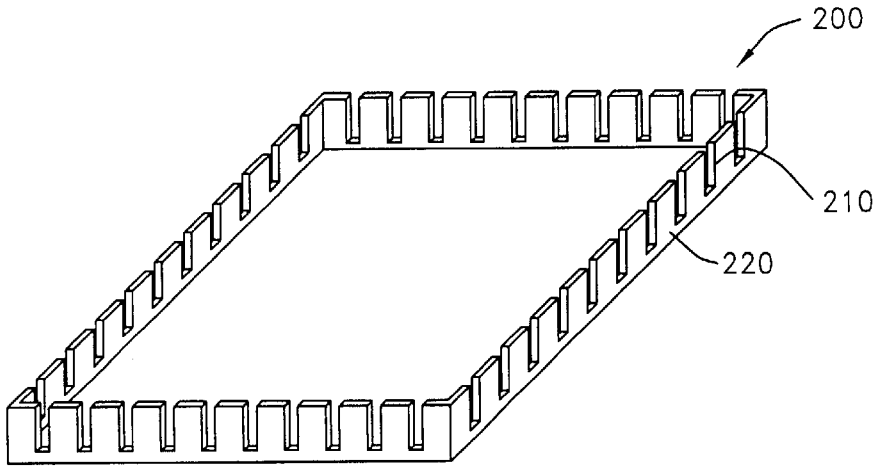
FIGS. 2A–2D illustrates views of different embodiments of the support member.

An alternative support member 200 embodiment is also shown in FIG. 2A. In FIG. 2A, the support member 200 may be formed separate from the containing chamber and attached to the containing chamber when the piteonata is constructed. In one embodiment, the support member 200 is formed as a substantially vertical form having a perimeter that is substantially equal to the perimeter of the opening of the containing chamber. The support member 200 may additionally have slots 210, slits, holes or other openings formed in the faces of the support member 200. The slots 210 may be sized to releasably attach the ribbons, other release mechanisms, and dummy release mechanisms of the piñata. The support member 200 may also be formed without slots 210 or other openings, and the ribbons or release mechanisms attached directly to the support member 200. Alternatively, the ribbons or release mechanisms may attach between the surface of the support member 200 and the inner chamber walls. The support member 200 may also include a strip 220, or strips, wherein the slots do not extend.

The support member 200 may be attached to the containing chamber using a variety of means. As an example, the strip 220, or strips, of the support member may be glued to the inner walls of the containing chamber such that the slotted portions extend above the opening of the inner chamber. The slots 210 may be positioned such that only a portion, or none, of the support member 200 extends above the opening of the containing chamber. The support member 200 may be attached to the containing chamber using adhesive, staples, tape, mechanical devices, an interference fit, or some other suitable attachment technique. Alternatively, the support member 200 may be attached to the outer walls of the containing chamber.

Figure 2B:
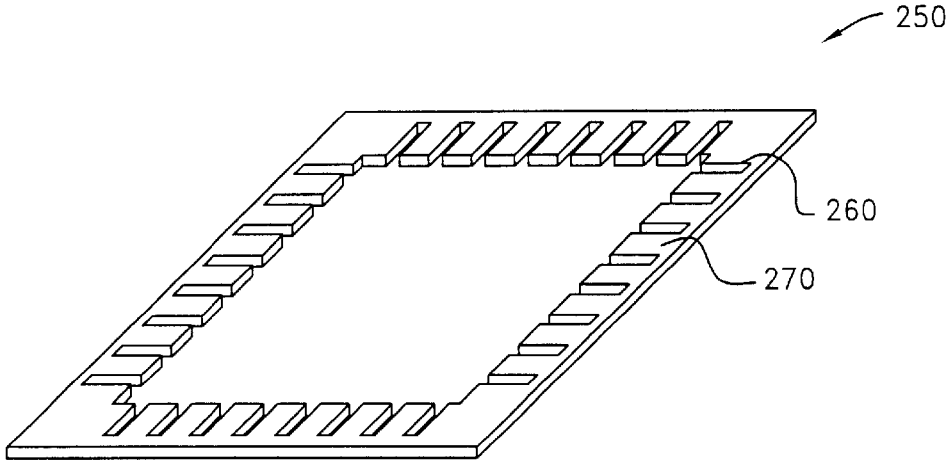

Another support member 250 embodiment is shown in FIG. 2B. The support member 250 is formed having a shape that extends substantially inward from the walls of the containing chamber. The support member 250 may include slots 260, slits, holes, or other openings to attach the ribbons, or other release mechanisms. Alternatively, the support member 250 may be substantially solid and the ribbons or other release mechanisms attached directly to the support member 250 using adhesive, tape, staples, or other attachment means. The support member 250 is shown to have an opening in the center. However, it may be appreciated that the support member need not have any opening. If it is desirable for the pull line used in the piñata to pass through the support member 250, an opening sufficient to pass the pull line will be needed. The opening may be within the support member 250 itself, or may be between the support member 250 and the containing chamber. The support member 250 has external dimensions that are substantially the same size as the internal dimensions of the containing chamber. The support member 250 may be inserted into the containing chamber and attached to the inner walls of the containing chamber.

Figure 2C:
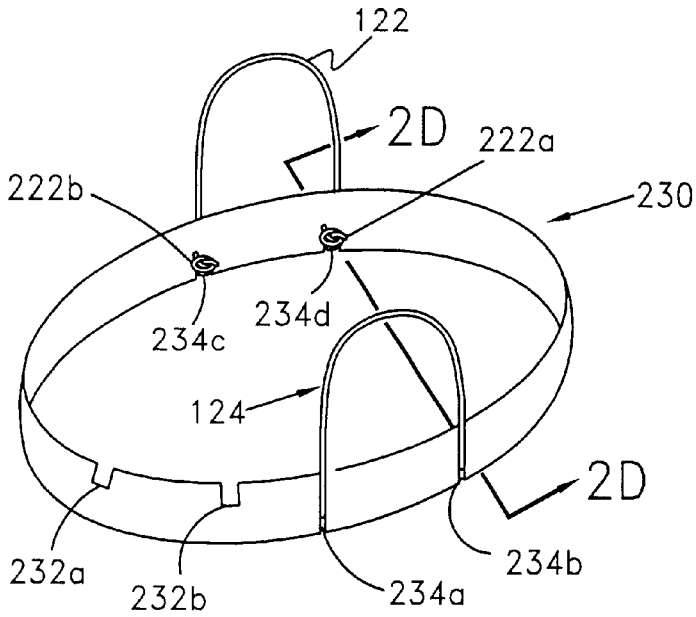

Another support member 230 embodiment is shown in FIG. 2C. The support member 230 is shown having a circular perimeter, although the support member 230 may have any outside shape. The support member 230 includes a number of slots 232*a*–232*b* positioned on an upper portion. These slots 232*a*–232*b* may be used to position a ribbon hanger illustrated in FIG. 9 and described in the accompanying text.

The support member 230 also includes a number of slots 234*a*–234*d* positioned on a lower portion. The slots 234*a*–234*d* may have a width that allows the width of a handle, e.g. 124, to pass through it. Each of the handles 122 and 124 may comprise string, twine, or some other cord or elongated structure. The ends of the handles 122 and 124 may be knotted. One of the knotted ends, for example 222*a*, is place on an inner surface of the support member 230 at the location of one of the slots, 234*d*. The handle 122 is treaded through the slot 234*d* and the knot 222*b* on the opposite end of the handle 122 is placed adjacent to another slot 234*c* on the support member 230. The slots 234*a*–234*d* have a width that allows the handles 122 and 124 to pass through but do not allow the knotted ends 222*a*and 222*b* to pass through.

A second handle 124 may be attached to the support member 230 in a similar fashion. The second handle 124 has similarly knotted ends (not shown). The knotted ends are placed in the inner surface of the support member 230 at the slots 234*a* and 234*b*. The remaining portion of the handle 124 is guided through the slots 234*a*-234*b* to the outside of the support member 230.

Figure 2D:
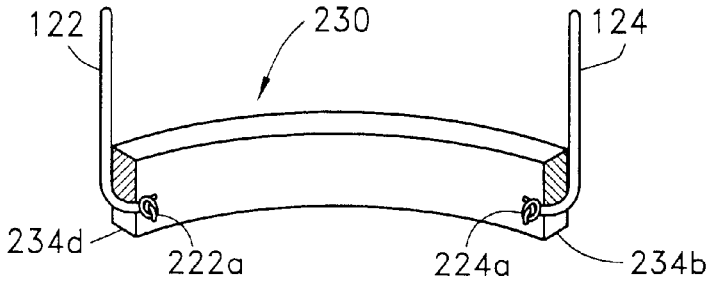

The placement of the knots and the handles 122 and 124 in relation to the support member 230 is shown in the cross section illustrated in FIG. 2D. FIG. 2D illustrates a cross section of the support member 230 along a line through two of the slots, 234*b* and 234*d*. The slots 234*b* and 234*d* are shown to extend from the bottom of the support member 230. However, the slots 234*b* and 234*d* extend only a portion of the height of the support member 230.

A first handle 122 has a first knotted end 222*a* that is inserted into a first slot 234*d*. Similarly, the second handle 124 has a first knotted end 224*a* that is inserted into a corresponding slot 234*b*. The second knotted ends (not shown) of the first and second handles 122 and 124 are inserted through corresponding slots in the support member 230. Each of the handles 122 and 124 is then positioned vertically along the edge of the support member 230. The support member 230 may then be attached to an inner chamber. The top of the inner chamber then conforms to the shape of the support member 230. Additionally, the inner chamber is provided the handles 122 and 124 from which it may hang. Thus the embodiment shown in FIG. 2C allows for the placement of handles 122 and 124 into an inner chamber.

The support member 230 embodiment of FIG. 2C may be manufactured and attached to the inner chamber in the following embodiment. One or more strips of a material of sufficient strength, such as cardboard, are formed into a support member having a perimeter that is substantially the same as the perimeter of the opening of the inner chamber. The support member 230 may be formed around a mold or other form having a predetermined outer dimension. The support member 230 may be formed having a circular cross section although it will be inserted in a generally rectangular shaped inner chamber. The opening of the inner chamber will conform to the shape of the support member 230.

The lower slots or slits, for example 234*a–d*, are placed in the support member 230. Similarly, the upper slots 232*a–b* are placed in the support member. The upper and lower slots may be placed in the support member before or after it is formed into the desired shape.

Two handles 122 and 124 are made from string. Each of the handles comprises a piece of string having knots, for example 222*a–b*, tied at substantially each end. One handle 122 is placed into a pair of slots 234*c* and 234*d* on the lower edge of the support member 230. Similarly, the second handle 124 is placed in a different pair of slots 234*a* and 234*b* on the lower edge of the support member 230. The handles 122 and 124 are fitted such that the knots are placed on the inner wall of the support member 230 and the remainder of the handle is on the outside of the support member 230.

The support member 230 and handles 122 and 124 are placed on a form in an inverted fashion. The knots for the handles 122 and 124 are still in the inside of the support member 230 and the remainder of the handles extends to the outside of the support member 230. The handles 122 and 124 in the inverted configuration extend downward away from the top edge of the support member 230. The handles 122 and 124 extend from the slots past substantially the entire outside height of the support member 230.

The outer edge of the support member 230 is then coated with glue or some other type of adhesive. The inner chamber is then inverted over the form and mated with the support member 230. Thus, when assembled over the form, the inner chamber is inverted and the outer wall of the support member 230 is glued to the inner wall of the opening of the inner chamber. The handles 122 and 124 are thus glued between the outer wall of the support member and the inner walls of the inner chamber. In this manner, an inner chamber having handles can easily be assembled.

The support member, 200, 230 or 250, may be made of cardboard or heavy paper. Alternatively, the support member, 200, 230, or 250, may be made of wood, metal, plastic, or some other material that has sufficient strength to support the ribbons and that may be attached to the containing chamber. As may be appreciated, the support member, 200, 230 or 250, may be formed from a single piece or may be formed from multiple pieces.

Figure 3:
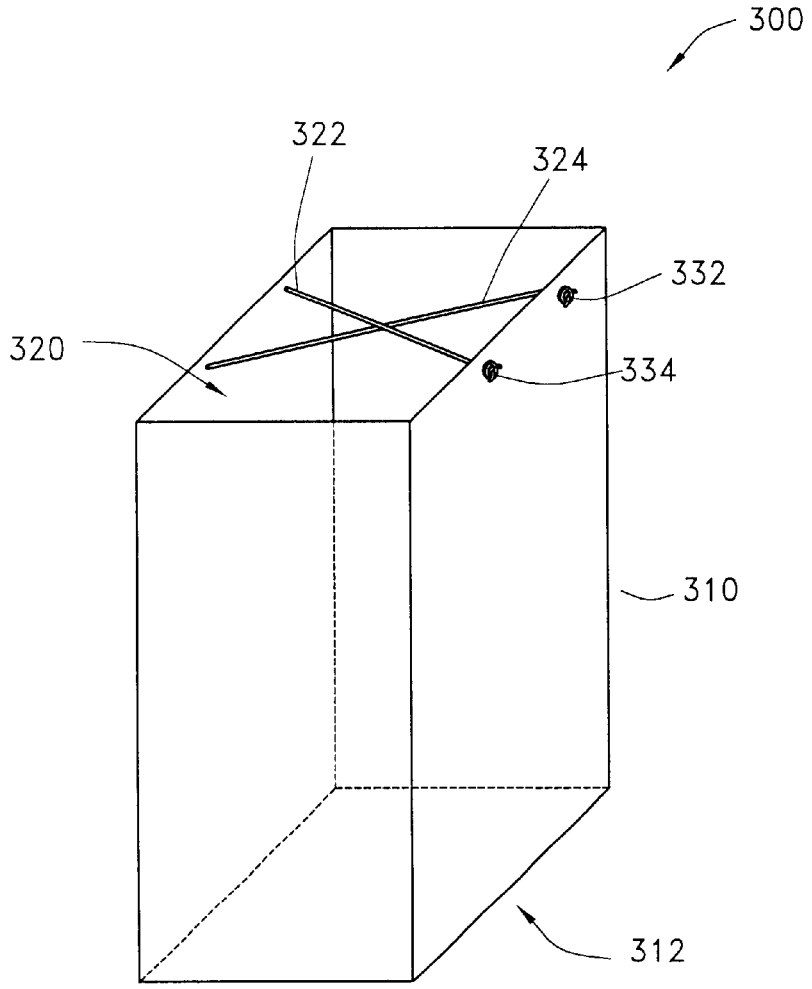
FIG. 3 illustrates an isometric view of a shroud chamber of a piñata.

An embodiment of the outer, or shroud, chamber 300 is shown in FIG. 3. The outer chamber 300 is shown as a bag 310, such as a paper bag. The outer chamber 300 thus has a generally rectilinear shape and has a top opening 320. The outer chamber 300 may have handles 322 and 324 attached to the top of the bag 310. The handles 322 and 324 for the outer chamber may be arranged in a crossed configuration. A first handle 322 may comprise a string having knots tied near each end. The first handle 322 is threaded from the outside of the outer chamber 310 through a first opening in the outer chamber 310. The first handle 322 is then threaded, from the inside of the outer chamber, through a second opening in the outer chamber 310. The first and second openings are typically placed on opposite walls of the outer chamber. Additionally, the second opening is typically not placed directly opposite the first opening. The end of the first handle 322 is then knotted 334 to keep it from slipping back through the opening in the outer chamber.

The second handle 324 is attached in a similar fashion. The second handle 324 has a knot placed on a first end. The second end is threaded, from the outside of the outer chamber, through an opening in the outer chamber 310. The second end is then threaded through another opening in the outer chamber 310. The second end of the second handle is then knotted 332 so that it does not slip back through the opening in the outer chamber 310. The openings in the outer chamber 310 for the second handle 324 are typically placed on opposite walls of the outer chamber 310. The openings in the outer chamber 310 are typically not placed directly opposite each other. The openings for the first and second handles 322 and 324 are placed such that the handles cross inside the opening of the outer chamber 310. The crossed configuration may be convenient because when the outer chamber 310 is assembled over an inner chamber, the outer chamber 310 is supported by the handles 322 and 324 resting on top of the inner chamber. Thus, the handles 322 and 324 of the outer chamber 310 do not themselves need to be hung from a hook or loop.

The outer chamber 300 also has a bottom opening 312. The bottom opening 312 may span the entire bottom surface of the bag 310, substantially all of the bottom surface of the bag 310, or only a portion of the bottom surface of the bag 310. It may be convenient to have the bottom opening 312 of the outer chamber 300 span the entire bottom surface of the bag 310, because then the bottom opening 312 can easily be produced by cutting the bag 310 to remove the bottom surface.

It may be convenient to use a bag 310 having attached handles, 322 and 324, as the outer chamber 300 because the bag 310 may be available having pre-printed text or graphics (not shown) along the outside surfaces. The use of bags 310 having pre-printed text or graphics was not desirable in prior art piñata embodiments because the outer chamber was inverted when the piñata was assembled. Thus, in prior art embodiments, the pre-printed text or graphics would be inverted in the completed piñata. The embodiments described herein, on the other hand, allow for the use of pre-printed bags having text or graphics because the pre-printed text or graphics are positioned to appear in the correct orientation in the completed piñata. The use of such pre-printed bags may allow also for a decrease in the cost to manufacture the piñatas. Additionally, the use of pre-printed bags allows for the decrease in the inventory of bags 310 required. In prior art piñatas the external graphics and text would need to be printed in an inverted orientation on a substantially solid color bag because there is little or no availability of bags having inverted text. The outer chamber disclosed herein may be constructed of a pre-printed bag. The pre-printed bag may have text or graphics commemorating specific occasions, for example birthdays, graduations, etc., and may be purchased from a party or novelty store.

Figure 4:
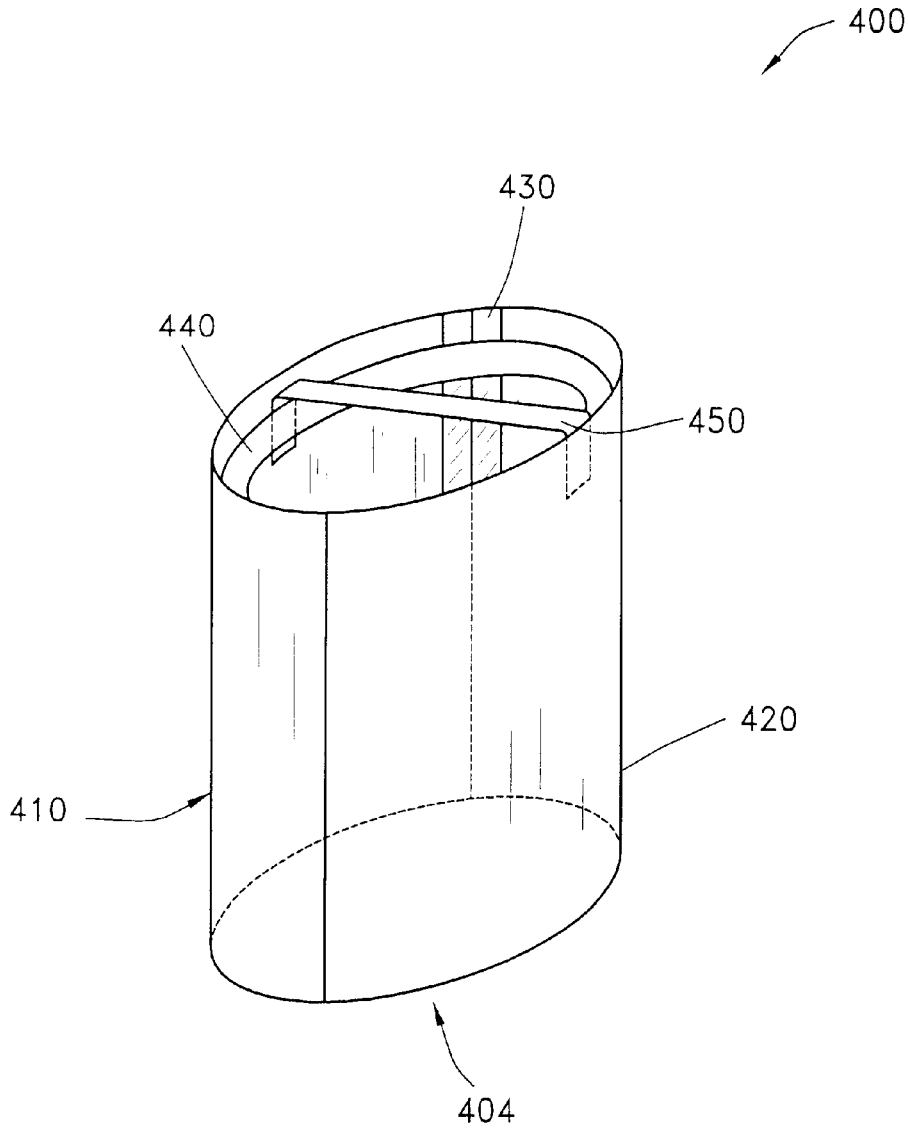
FIG. 4 illustrates an isometric view of an alternative embodiment of a shroud chamber of the piñata.

An alternative embodiment of an outer chamber 400 is shown in FIG. 4. In this embodiment, the outer chamber 400 comprises a sheet, or a plurality of sheets of paper or some other substantially flat formable material. Each sheet may be printed with text or graphics, or the sheets may comprise pre-printed sheets. The outer chamber 400 embodiment of FIG. 4 comprises two sheets of paper, 410 and 420, although it may be appreciated that there is no limit to the number of sheets of paper that may be used to form the outer chamber 400. The first sheet 410 is attached to the second sheet 420 along one edge of each sheet. The two sheets, 410 and 420, may be attached with adhesive, tape, staples, or some other means of attachment. The first sheet 410 is shown as being attached to the second sheet 420 with a piece of tape 430 that extends the length of the sheets. The opposite edge of the sheets, 410 and 420, are likewise attached such that the sheets form an outer chamber 400 having an inside surface and an outside surface. Opposite ends of the outer chamber 400 are open. One or more supports 450 or handles may be attached to the open end of the outer chamber 400 to support the outer chamber 400 when it is used in an assembled piñata. A form 440, alternatively referred to as a rim, may be inserted in a first open end of the outer chamber 400. The form 440 may be of any shape and is shown in FIG. 4 to be of generally circular shape. The outside area of the form 440 may be substantially the same as the inside area of the outer chamber 400. The cross section of the outer chamber 400 conforms to the shape of the form 440. The form 440 may be attached to the sheets of the outer chamber 400 using an adhesive, tape, or other attachment means. Additionally, the outline of the form 440 may be substantially the same as the area defined by the sheets, such that the form may be supported and attached in the outer chamber 400 by interference fit. A single support 450 may be attached to the outer chamber 410 by placing its ends between the form 440 and the inner walls of the outer chamber 410. The support 450 may be a single strip of paper or other material extending from one side of the outer chamber 410 to another. The support 450 formed in this manner allows the outer chamber 410 to be supported by the inner chamber when the two are assembled together. The handles of the inner chamber may extend alongside and above the support 450.

The second, or bottom opening 404 of the outer chamber remains open. The ribbons of the piñata extend through the bottom end 404 when the piñata is assembled.

Figure 5A:
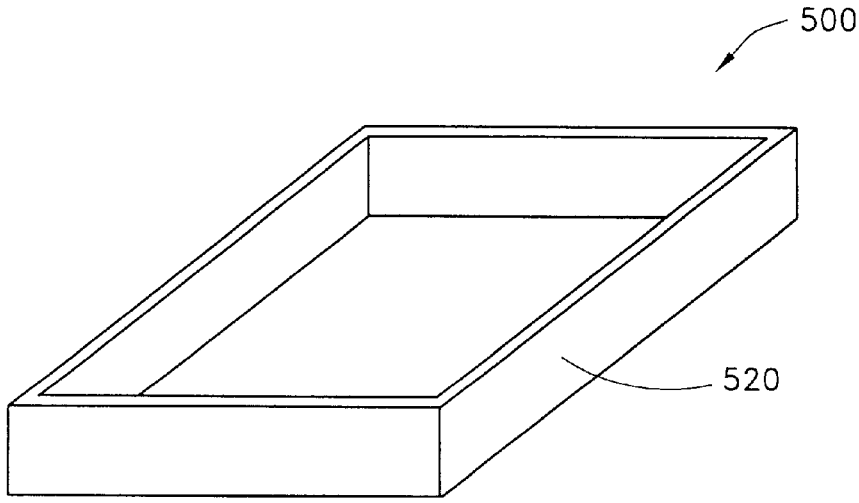
FIGS. 5A–5B illustrate forms for use with the shroud chamber of a piñata.

One embodiment of a form 500 is shown in FIG. 5A. The form 500 has a generally rectangular outline. Thus, when inserted into the top opening of the outer chamber, the cross section of the outer chamber will reflect a rectangular shape. The outer chamber may have folds, or creases in the walls of the chamber to better conform to the rectangular form 500. The outer surface 520 of the form 500 may be glued to the inner surface of the outer chamber.

Figure 5B:
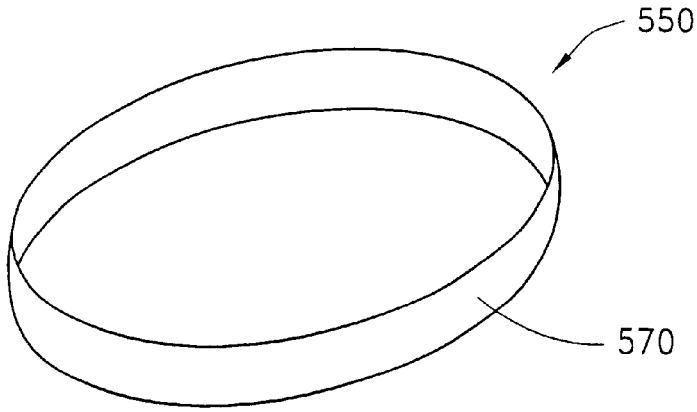

A form 550 having a substantially circular outline is shown in FIG. 5B. The form 550 allows the handles of the containing chamber to pass through. The outer surface 570 of the form 550 may be glued to the inner surface of the outer chamber.

Figure 6:
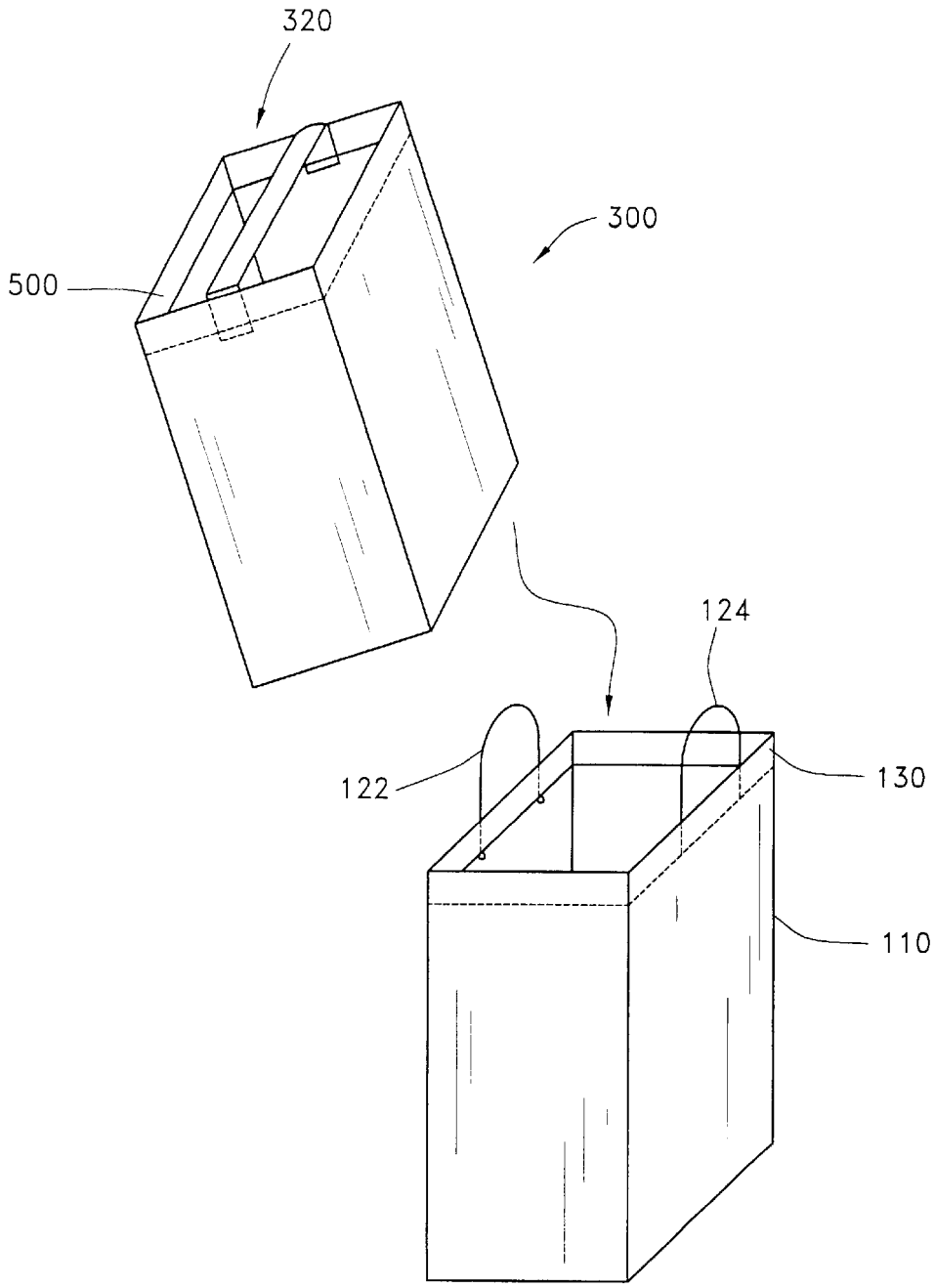
FIG. 6 illustrates the placement of a shroud chamber over a containing chamber to form an enclosed container, such as a piñata.

FIG. 6 shows the placement of the outer chamber 300 over the containing chamber 110. The outer chamber 300 has a rectangular form 500 placed in the upper opening 320 to make the cross section of the outer chamber 300 conform to the rectangular outline of the form 500. The form 500 is also used to attach the support 450 to the outer chamber 300. The support 450 rests on the top of the inner chamber 110 when assembled. The outer chamber 300 is placed over the containing chamber 110 to shroud the placement of any ribbons (not shown) on the support member 130 attached to the opening of the containing chamber 110. The handles of the containing chamber, 122 and 124, extend through the opening in the outer chamber 300. Thus, it may be seen that when the outer chamber 300 is placed over the containing chamber 110, the inner chamber is concealed, or shrouded.

Figure 7A:
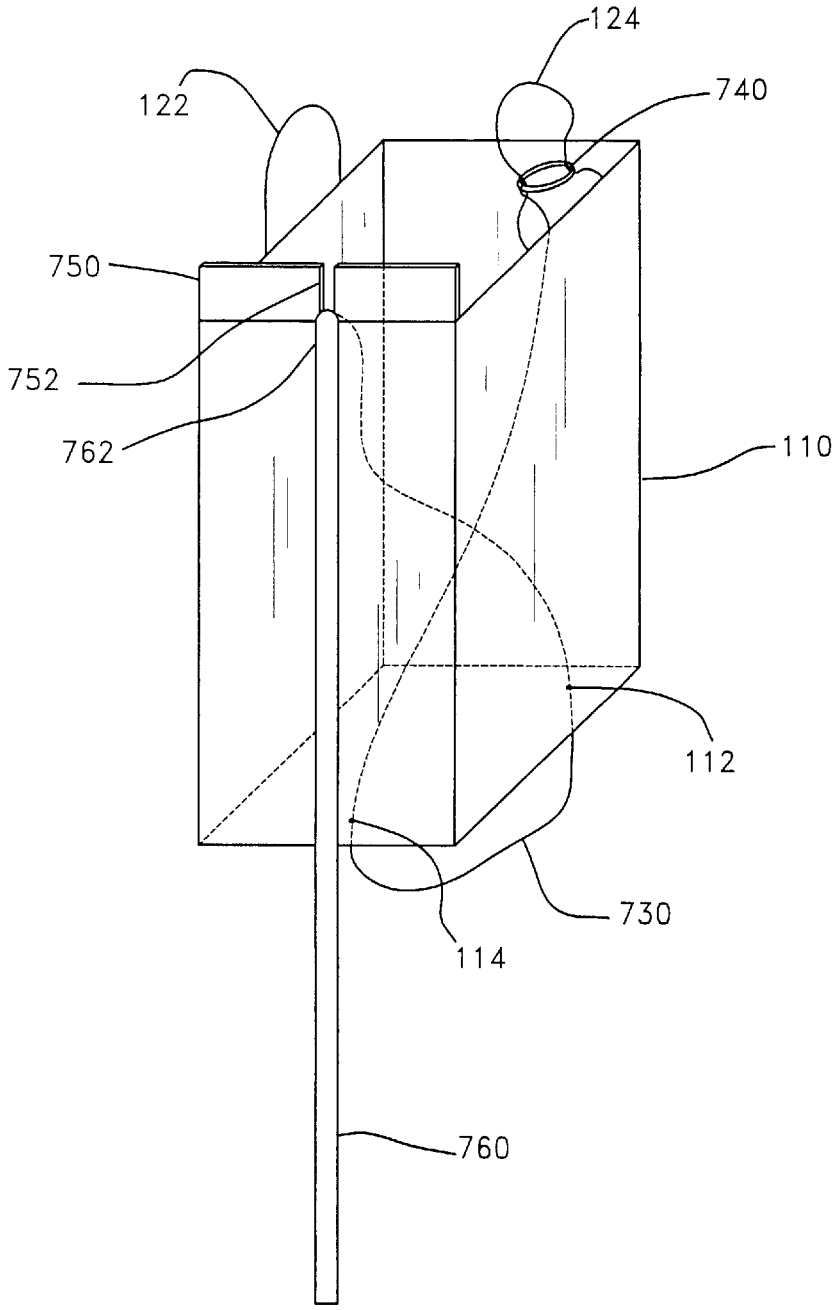
FIGS. 7A–7B illustrate isometric views of different embodiments of a containing chamber and, specifically, illustrates an attached ribbon and a pull line affixed at one end to that ribbon.

FIG. 7A shows a placement of the "winning" ribbon 760 and an embodiment in which the pull line 730 is routed within the containing chamber 110 to a ring 740. The containing chamber 110 having two handles 122 and 124 is as previously described. The containing chamber 110 also includes two pin holes, 112 and 114, through the bottom surface of the containing chamber 110. One of the pin holes 114 may be placed near one edge of the bottom surface. The other pin hole 112 is placed near an opposite edge of the bottom surface, such that when the pull line 730 is pulled with sufficient force, the bottom surface is ruptured for substantially the entire length.

A support member 750 is placed along at least one edge of the containing chamber 110. The support member is shown to attach to only a single wall of the containing chamber for the sake of clarity. The support member 750 has placed a slot 752. A "winning" ribbon 760 has an upper end 762 inserted through the slot 752 to attach the ribbon 760 to the support member 750. The upper end 762 of the ribbon 760 is also attached to one end of a pull line 730. The pull line 730 may be attached to the ribbon 760 using tape, adhesive, staples, or other attachment means. The pull line 730, which may be a nylon fishing line, a piece of high-tensile-strength wire, a piece of dental floss, a piece of nylon cord, or the like, is threaded through one of the pin holes 112 to the outside of the containing chamber 110 then back into the containing chamber 110 through the other pin hole 114. The pull line 730 then extends to a second point where it is attached to a ring 740. The second point on the pull line 730 may be any position along the pull line 730, however, the second point is typically placed near an end of the pull line 730 opposite the ribbon 760 attachment.

The ring 740 may be a continuous ring or may be a portion of a ring, a hook, clasp, loop, eye, bolt, rivet, nail, screw, or other means for support and attaching the pull line 730. Alternatively, the ring 740 may be formed using a portion of the pull line 730. The ring 740 is placed on a locating point in order to provide a support for the pull line 730 such that the pull line 730 may be pulled with sufficient force to rupture the containing chamber 110. The ring may be attached to a face of the containing chamber 110, or looped over one or both of the handles 122 and 124. The ring 740 is shown to be placed over one of the handles 124 in FIG. 7. As may be appreciated, the ring 740 may be placed or supported at a location point that is separate from the piñata, such as the support that is used to hang the piñata.

The ring 740 and ribbon 760 may be oriented such that the pull line 730 crosses internal to the containing chamber 110. The crossed configuration of the pull line 730 may facilitate ripping or rupturing of the containing chamber 110 when the pull line is pulled with sufficient force.

Figure 7B:
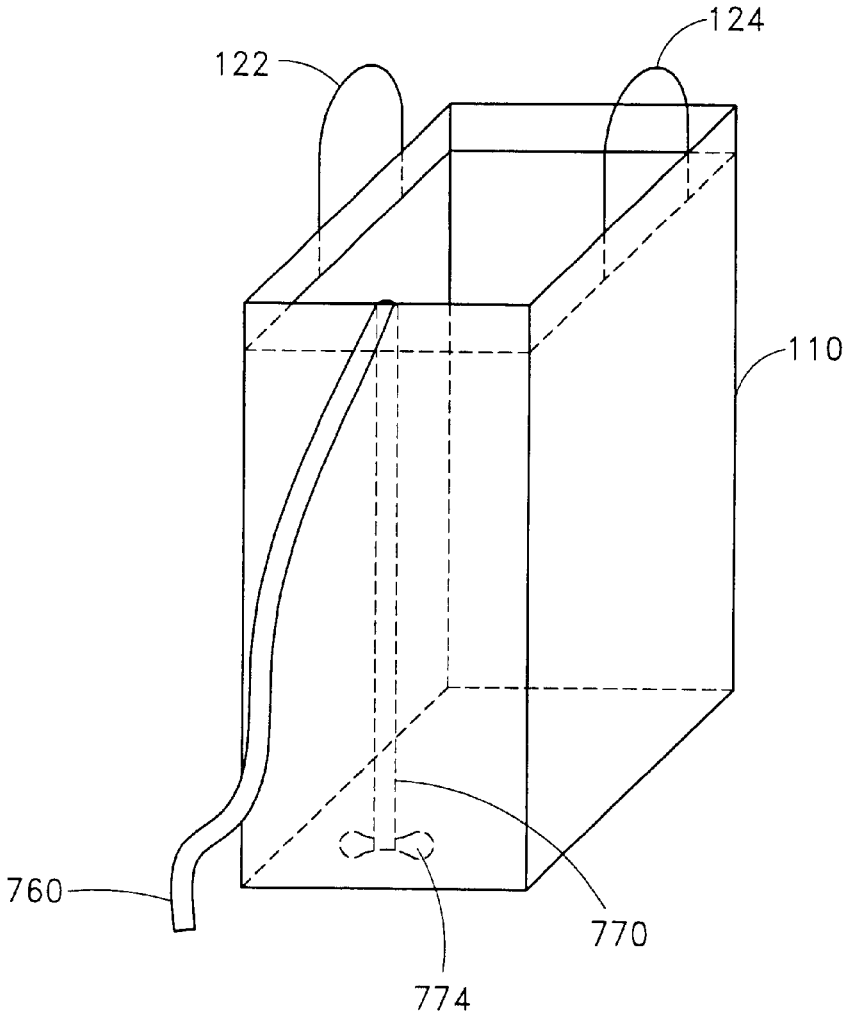

FIG. 7B shows an embodiment of the inner chamber having a pull line 770 configuration that does not require holes to be placed in the inner chamber. In this embodiment, the pull line 770 is affixed to an inner surface of the inner chamber 110. The pull line 770 may be a piece of filament tape or a line, string, fishing line, dental floss, wire, or some other suitable line attached to the inside wall of the inner chamber. It may be convenient to use filament tape as the pull line 770 because it may be easily attached to an inner wall of the inner chamber. Where some other means is used for the pull line 770, the line is attached to the inner wall using tape, adhesive, or some other means for attachment.

One end of the pull line is attached to the winning ribbon 760. Where filament tape is used for the pull line 770, the filament tape may be attached directly to the ribbon 760 using the adhesive on the filament tape. If some other means is used for the pull line 770, some means for attachment is used to attach the pull line 770 to the ribbon 760. As before, the winning ribbon 760 typically hangs straight downward when the piñata is assembled. The configuration of the winning ribbon 760 in an assembled piteonata is typically indistinguishable from a non-winning, or dummy ribbon. The winning ribbon 760 is shown in FIG. 7B as extending away from the inner chamber 110 to allow the structure of the pull line 770 to be more easily seen.

The pull line 770 extends against the inner surface of the inner chamber and between the inner chamber wall and support member if a support member is used. In this configuration, the pull line 770 does not need to rupture the support member. Adhesive attaching the support member to the inner chamber may be omitted in the area of the pull line 770. However, the operation of the pull line 770 does not change significantly if adhesive is used between the pull line 770 and the support member. A slightly greater force may be required to separate the pull line 770 if it is attached to the support member. The pull line 770 may extend beneath, that is between the support member and the inner chamber in some embodiments. The pull line 770 may extend over the support member in other embodiments. Where the pull line 770 extends over the support member, the pull line 770 extends over the wall of the support member that is not attached to the inner chamber.

The end of the pull line 770 opposite the ribbon 760 may extend to the bottom of the inner chamber or may extend only partially down the inner chamber wall. Optionally, the end of the pull line 770 opposite the ribbon 760 may be attached to a stick 774 or rod. The stick may be a wooden stick, such as a popsicle stick, a plastic stick, a dowel, a metal rod, a flat metal piece, a piece of cardboard, or some other suitable structure. The stick 774 may be placed along the bottom of the inner chamber substantially lying parallel to the bottom of the chamber. The stick 774 is typically placed in an orientation that is orthogonal to the axis along the length of the pull line 770. The length of the stick 774 is typically greater than the width of the pull line 770 and may be substantially as long as the dimension of the inner chamber 110 wall which it may rest against. The stick 774 positioned as such improves the rupturing of the inner chamber 110 when the pull line 770 is pulled with sufficient force.

The previous embodiment shown in FIG. 7A included a pull line 730 that extended through holes 112 and 114 in the floor of the inner chamber 110. When the ribbon 760 is pulled, the pull line 730 exerts an upward force on the inner chamber 110. Some of the upward force is redirected to a horizontal tearing force by the use of the crossed pull line 730 configuration.

The pull line 770 of the embodiment of FIG. 7B may facilitate rupturing of the inner chamber 110. The embodiment of FIG. 7B uses a pull line 770 configuration that exerts significantly greater downward tearing force over previous embodiments. When the winning ribbon 760 is pulled with sufficient force, the attached pull line 760 is pulled downward exerting a tearing force on the side of the inner chamber wall. As the ribbon 760 is pulled, the exerted force tears the wall of the inner chamber 110. When the force on the pull line 770 reaches the bottom of the inner chamber, the force is transferred to the opposite end of the pull line 770. Recall that the opposite end of the pull line 770 is attached to a stick 774. The pulling force then is applied to the stick 774 and against the side of the inner chamber 110. If pulled with sufficient force, the stick 774 creates a massive rupture in the inner chamber 110 causing a sudden release of any treats contained therein. This pull line 770 configuration is advantageous because the tearing force applied by the pull line 770 is in substantially the same downward direction experienced by the pulled ribbon 760. The stick 774 adds to the excitement by creating an explosive effect as it is ruptures the inner chamber 110.

Figure 8:
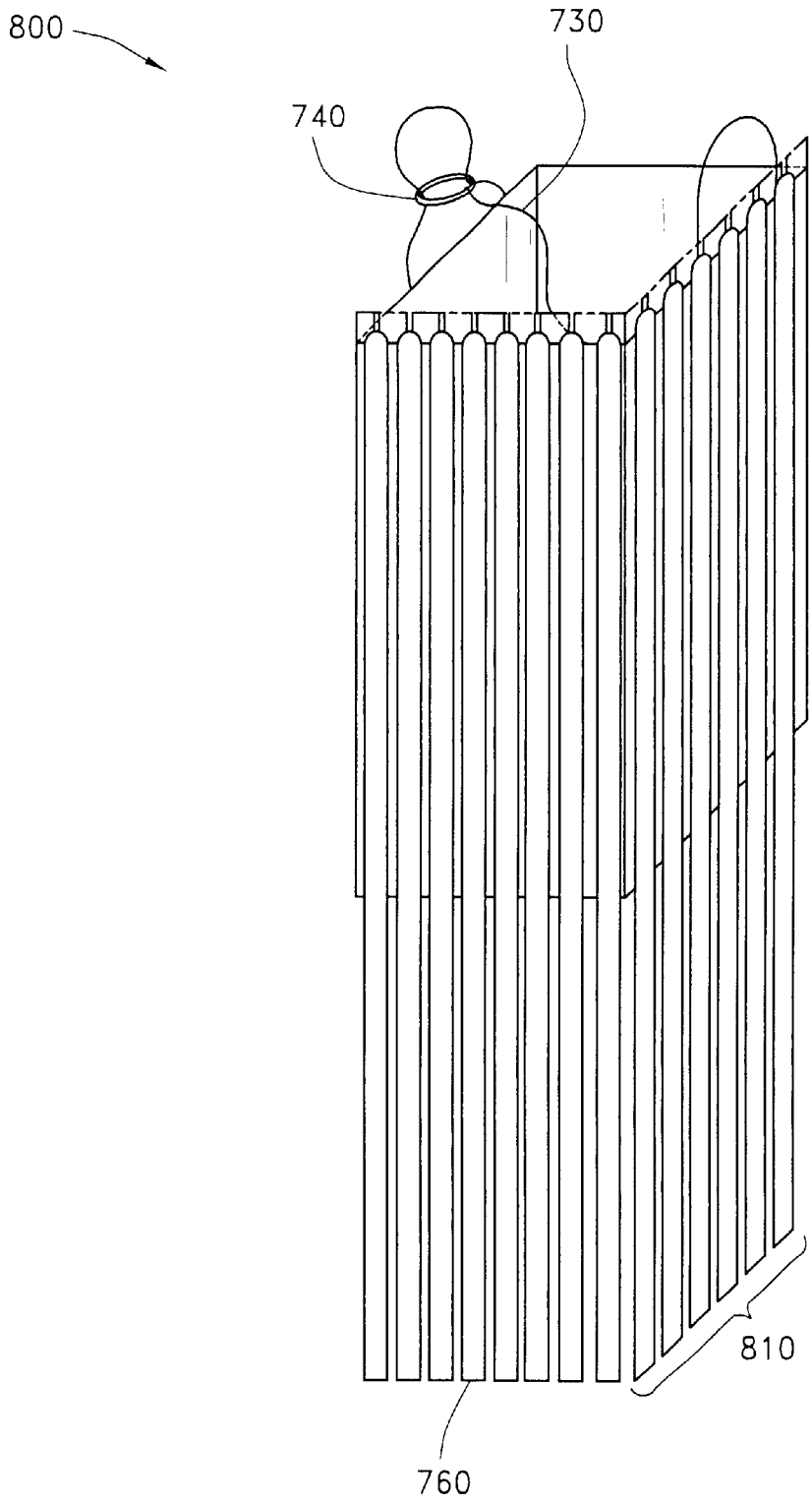
FIG. 8 illustrates an isometric view of a containing chamber of a piñata having removably attached ribbons.

FIG. 8 shows an embodiment in which an assembled container 800 includes a support member and a plurality of ribbons attached. At least one ribbon 760 is attached to the pull line 730, which attached at an opposite end to a ring 740. The ring 740 is looped over one of the containing chamber handles to provide a support for the ring 760. A number of non-winning, dummy ribbons, or ribbons other than the designated "winning" ribbon, for example those identified by reference number 810, are also attached to the support member. Each of the ribbons 760 and 810 is attached to a corresponding slot in the support member. Thus, each of the ribbons appears to present an equal winning opportunity to a participant.

Figure 9A:
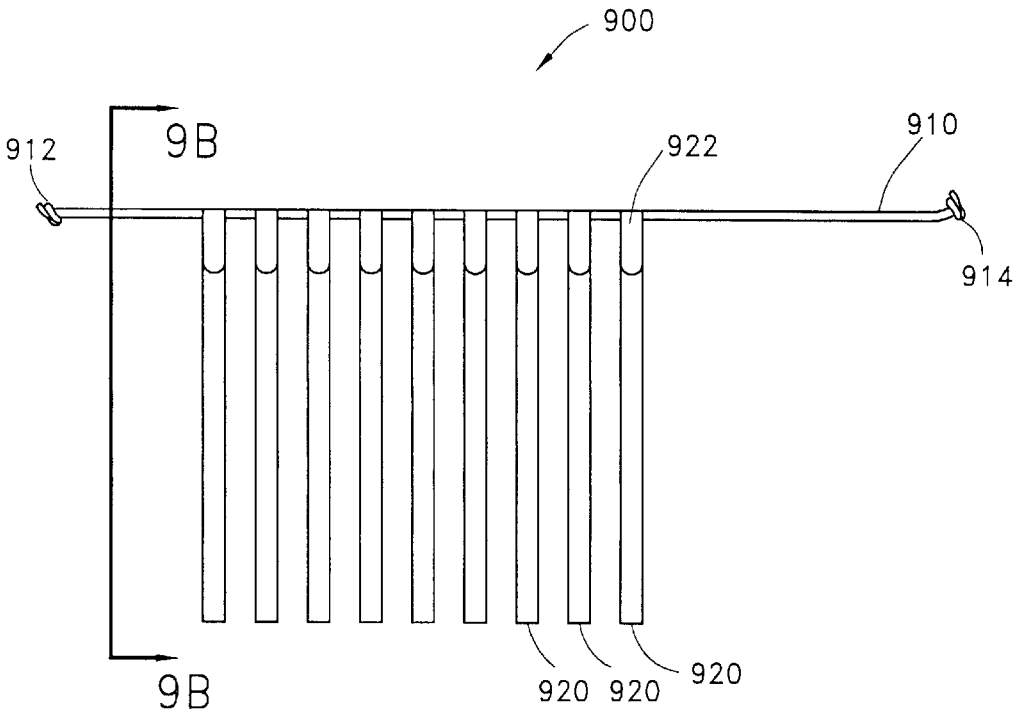
FIGS. 9A–9B illustrate views of an alternative embodiment for attaching the winning ribbons on the hanger.

FIG. 9A shows an embodiment that allows for assembling the non-winning ribbons 920 onto a hanger 910 such that the piñata may be quickly assembled without having to separately attach each non-winning ribbon 920 to a support member on the inner chamber.

The hanger 910 may conveniently be made from a piece of string, twine, wire, rope, filament, or other suitable means. In one embodiment, the hanger 910 is made of string and has knots 912 and 914 tied on the ends. The non-winning ribbons 920 are attached to the hanger 910 with substantially equal spacing. Typically, a sufficient number of non-winning ribbons 920 are attached to the hanger 910 to substantially wrap around the entire inner chamber when installed on the top of the inner chamber.

The hanger 910 with a plurality of ribbons 920 attached thereto, may be conveniently attached to the top edge of the inner chamber. The assembled hanger 910 with ribbons 920 may be attached to the support member that is attached to the top edge of the inner chamber. Referring back to FIG. 2C, two slots 232*a* and 232*b* are positioned on the top of the support member 230. These two slots 232*a* and 232*b* are at the top edge of the inner chamber when the support member 230 is attached to the inner chamber. The ends of the hanger 910 may be located at the upper slots. For example, one knotted end 912 of the hanger may be positioned into a first slot 232*a* (FIG. 2C) with the knotted end 912 placed on the inside of the inner chamber. Then the hanger 910 with the ribbons 920 is wrapped around the outside top opening of the inner chamber and the second knotted end 914 is positioned in the second slot 232*b* (FIG. 2C). The length of the hanger 910 may be about the same as the perimeter of the inner chamber such that a single row of ribbons 920 wraps around the inner chamber. The hanger 910 may also be supported at intermediate points along the top edge of the inner chamber using adhesive, tape, staples, clips, or other means for support.

The non-winning ribbons 920 may be attached to the hanger 910 by a variety of means. The ribbons 920 may be attached to the hanger 910 using adhesive, tape, staples, buttons, snaps, by tying the ribbons 910, by tying the hanger 910, or some other means. In one embodiment, the ribbons are each attached using a corresponding label 922. The label may include writings in which questions are asked, deeds are assigned, or prizes may be awarded to the participant. These questions, deeds, prizes or the like are selected so as to be suitable for the participants of the game. For example, simple questions may be used for a child's birthday group, and academic questions used for a school party. Also, as may be appropriate for occasion, deeds may include singing a birthday song, dancing a dance, reciting the alphabet backwards, or the like. Alternatively, the writings may be included on the end of the ribbons 920.

Figure 9B:
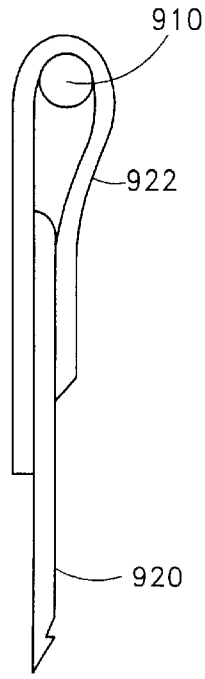

A detailed view of an embodiment of attaching a ribbon 920 to the hanger 910 is shown in FIG. 9B. The hanger 910 is shown in cross section as perpendicular to the drawing sheet. The top portion of a ribbon 920 is shown attached to a label 922. The label may be an adhesive label. A portion of the adhesive side of the label 922 may attach to the upper end of the ribbon 920. The label 922 may then be wrapped around the hanger 910 and attached to the opposite side of the top of the ribbon 920. Alternatively, the label 922 may be attached to the ribbon 920 using tape, adhesive, clips, staples, or some other means for attachment. Writing, text, or graphics on the label 922 is typically positioned such that it does not extend to the portion of the label that wraps around the hanger 910. The ribbon 920 and label 922 configured as such allows easy removal from the hanger 922. When the ribbon 920 is pulled with sufficient force, the label 922 tears at the portion of the label 922 resting on top of the hanger 910. Alternatively, the adhesive portion of the label 922 may release from one or both sides of the ribbon 920 and allow the ribbon 920 to be released from the hanger 910. A participant may be able to read the text printed on the label 922 attached to the ribbon 920 even after the label 922 tears.

Figure 10A:
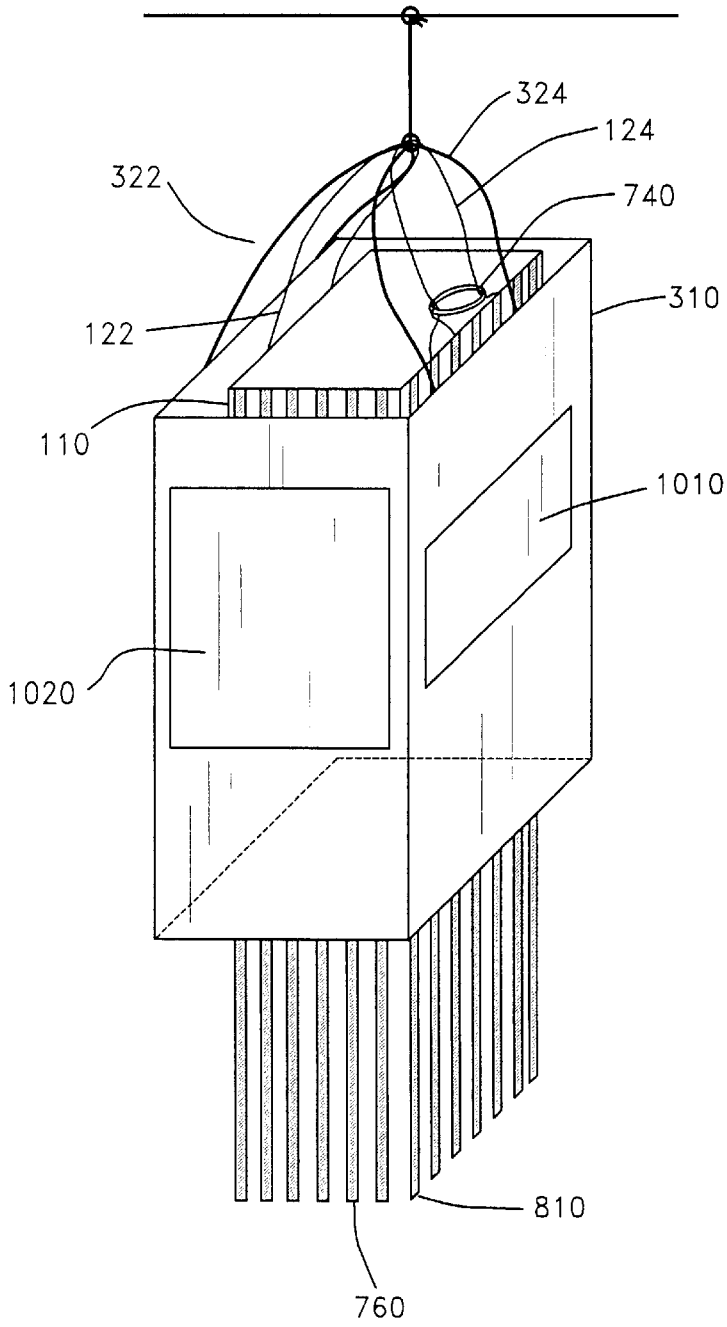
FIGS. 10A–10B illustrate isometric views of completed piñatas in a ready-to-use state.

FIG. 10A shows an embodiment of a completed piñata. This embodiment of the piñata comprises an inner chamber 110 supporting a number of ribbons. One of the ribbons 760 is attached to a pull line that in turn attaches to a ring 740 that is looped over one handle 124 of the inner chamber 110. The inner chamber 110 is supported using the handles 122 and 124. The winning ribbon 760 and additional ribbons, for example 810, are also attached to the inner container 110 or a support member (not shown) on the inner chamber 110. An outer chamber 310, or shroud chamber, is placed over the inner chamber 110 to conceal the location of the ribbons, 740 and 810, and to provide a decorative finish to the piñata. The outer chamber 310 may also have handles 322 and 324 that are supported at the same positions as the handles 122 and 124 of the inner chamber 110. Pre-printed text or graphics 1010 and 1020 or subsequently applied text or graphics may appear on different faces of the outer chamber 310. Thus, the outer chamber 310 allows the ribbons to be accessible to the participants while shrouding the configuration of the ribbons and the inner container 110.

Figure 10B:
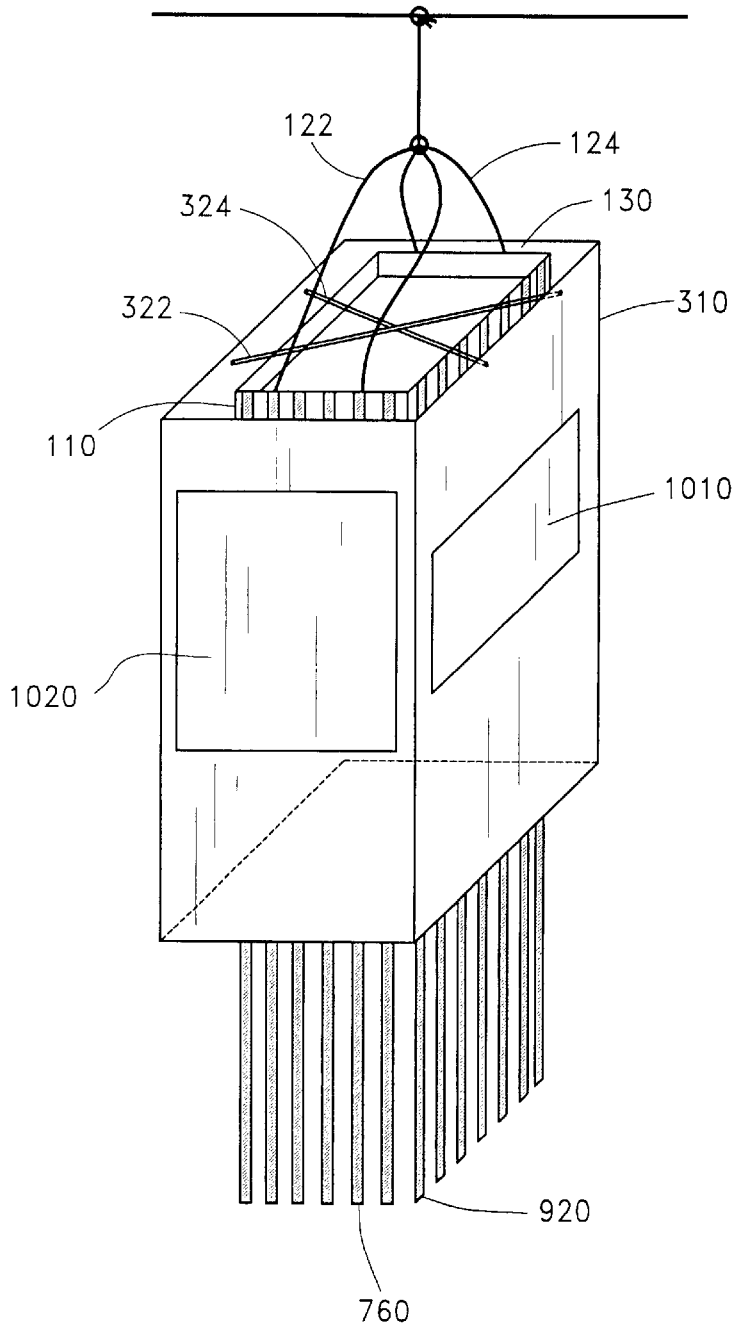

FIG. 10B shows another embodiment of a completed piñata. This embodiment of the piñata comprises an inner chamber 110 having a support member 130 and hanger supporting a number of ribbons. The hanger supports a number of ribbons 920 as is described in the embodiment of FIG. 9A. The hanger is wrapped around the top opening of the inner chamber 110 and attached to the support member 130. The inner chamber 110 is supported using the handles 122 and 124. The handles 122 and 124 are also attached to the inner chamber 110 using the support member 130. Each handle 122 and 124 is glued in between the support member 130 and the upper opening of the inner chamber 110.

One of the ribbons 760 is attached to a pull line that is attached to an inner wall of the inner chamber 110. The pull line (not shown) is a length of filament tape taped to the inside wall of the inner chamber 110. The filament tape is typically taped opposite the surface of the inner chamber 110 where the winning ribbon 760 is placed.

An outer chamber 310, or shroud chamber, is placed over the inner chamber 110 to conceal the location of the ribbons, 760 and 920, and to provide a decorative finish to the piñata. The outer chamber 310 may also have handles 322 and 324 that are supported by inner chamber 110. The handles 322 and 324 of the outer chamber are arranged such that they cross over the opening of the inner chamber 110. The inner chamber 110 is able to support the outer chamber 310 because the inner chamber 110 includes the support member 130 attached at the opening. Thus, the handles 122 and 124 of the inner chamber support the completed piñata and no other handles need to be externally supported. Pre-printed text or graphics 1010 and 1020 or subsequently applied text or graphics may appear on different faces of the outer chamber 310. Thus, the outer chamber 310 allows the ribbons to be accessible to the participants while shrouding the configuration of the ribbons and the inner container 110.

The above description of the disclosed embodiments is provided to enable any person skilled in the art to make or use the invention. Various modifications to these embodiments will be readily apparent to those skilled in the art, and the generic principles defined herein may be applied to other embodiments without departing from the scope of the invention. Thus, the invention is not intended to be limited to any one, or all, of the embodiments shown and described herein, but rather is to be accorded the widest scope consistent with the various principles and features, including novel features, as disclosed herein.

What is claimed is:

1. A piñata, comprising:

a first chamber having an opening on one side;

a plurality of handles fixably attached to the first chamber and extending outwardly from the opening of the first chamber;

a support member attached to the first chamber at substantially the first chamber opening;

a pull line, fixably attached at a first point to a first ribbon, the pull line fixably attached to an interior wall of the first chamber so that when the first ribbon is pulled with sufficient force the first chamber will rupture; and a second chamber having first and second openings on opposite sides and being positioned atop the first chamber to shroud the first chamber, wherein the first opening of the second chamber is positioned on the same side as the first chamber opening.

2. The piñata of claim 1, further comprising a plurality of additional ribbons removably attached to the first chamber.

3. The piñata of claim 1, wherein the plurality of handles are attached to the support member and the support member is attached to the inner chamber such that the ends of the handles are positioned in between the support member and the inner chamber.

4. The piñata of claim 3, wherein the support member has a plurality of lower slots, and wherein the plurality of handles are attached to the support member at the lower slots.

5. The piñata of claim 1, further comprising a plurality of additional ribbons, wherein each of the additional ribbons is removably attached to a hanger and the hanger is attached to the inner chamber.

6. The piñata of claim 5, wherein each of the plurality of additional ribbons is attached to the hanger using an adhesive label.

7. The piñata of claim 5, wherein the hanger is a length of string and the hanger having the plurality of additional ribbons attached thereto is attached to the inner chamber by inserting substantially ends of the hanger into a pair of upper slots placed in the support member.

8. The piñata of claim 1, further comprising a plurality of additional ribbons, wherein each of the additional ribbons is removably attached to the inner chamber.

9. The piñata of claim 1, wherein the pull line is a length of filament tape attached at one end to the first ribbon and taped to the interior wall of the inner chamber.

10. The piñata of claim 1, wherein an end of the pull line opposite the first ribbon is attached to a stick.

11. The piñata of claim 1, further comprising a support fixably attached to the second chamber and extending from the first opening.

12. The piñata of claim 11, wherein the support rests on top of the inner chamber to support the second chamber.

13. The piñata of claim 1, wherein the second chamber comprises a plurality of sheets of paper, wherein at least two of the plurality of sheets of paper are attached at an edge to form sides of the second chamber.

14. The piñata of claim 13, further comprising a form having a perimeter substantially equal to a perimeter of the first opening of the second chamber, wherein the form is inserted in the first opening of the second chamber such that a cross section of the second chamber conforms to a shape of the form.

15. The piñata of claim 1, wherein the second chamber comprises a paper bag having openings at a top and a bottom of the paper bag.

16. The piñata of claim 1, wherein the second chamber comprises a bag having a plurality of supports extending outwardly from a top of the bag and wherein substantially all of a bottom of the bag is removed.

17. The piñata of claim 16, further comprising a form having a perimeter substantially equal to a perimeter of the first opening of the second chamber, wherein the form is inserted into the first opening of the second chamber.

18. A piñata comprising:

a first chamber having an opening on one side;

a support member fixably attached inside the first chamber substantially near the opening, wherein the support member has a plurality of slots;

a handle fixably attached to at least one of the plurality of slots in the support member, the handle extending outwardly from the opening of the first chamber;

a pull line, fixably attached at a first point to a first ribbon, the pull line fixably attached in substantially a vertical orientation to an interior wall of the first chamber so that when the first ribbon is pulled with sufficient force the first chamber will rupture; and a second chamber having first and second openings on opposite sides positioned atop the first chamber to shroud the first chamber, and wherein the first opening of the second chamber is positioned on the same side as the first chamber opening.

19. The piñata of claim 18, further comprising a plurality of additional ribbons each removably attached to a hanger, the hanger attached to the support member.

20. The piñata of claim 18, wherein the first chamber comprises a paper bag and the support member is attached to the opening of the paper bag using adhesive.

21. The piñata of claim 18, wherein the pull line and first ribbon are positioned on substantially opposite sides of the same inner chamber wall.

22. The piñata of claim 18, wherein the second chamber comprises a bag having a plurality of supports extending outwardly from the first opening, and wherein a bottom of the bag is removed.

23. A piñata comprising:

containing means having an opening on one side, and a plurality of handles fixably attached to the containing means and extending outwardly from the opening of the containing means;

means for releasing contents from the containing means, the means for releasing removably attached to the first containing means;

means for rupturing the containing means, the means for rupturing fixably attached at a first point to the means for releasing, the means for rupturing fixably attached to an interior wall of the containing means so that when the means for releasing is pulled with sufficient force the containing means will rupture; and means for shrouding the containing means, the means for shrouding having first and second openings on opposite sides and being positioned atop the containing means to shroud the containing means, wherein the first opening of the means for shrouding is positioned on the same side as the first chamber opening.

* * * * *